US007298997B2

(12) United States Patent
Hamada et al.

(10) Patent No.: US 7,298,997 B2
(45) Date of Patent: Nov. 20, 2007

(54) COLOR IMAGE FORMING APPARATUS WITH PRE-CHARGING UNIT AND POTENTIAL ADJUSTMENT UNIT

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/183,705

(22) Filed: Jul. 18, 2005

(65) Prior Publication Data

US 2006/0088342 A1 Apr. 27, 2006

(30) Foreign Application Priority Data

Oct. 26, 2004 (JP) ..... 2004-310705

(51) Int. Cl.
*G03G 15/16* (2006.01)

(52) U.S. Cl. ..... 399/296

(58) Field of Classification Search ..... 399/296, 399/299, 302

See application file for complete search history.

(56) References Cited

U.S. PATENT DOCUMENTS 4,402,591 A * 9/1983 Nakahata ..... 399/296
5,999,783 A * 12/1999 Folkins ..... 399/296
6,813,463 B2 * 11/2004 Kamiyama ..... 399/302
6,895,204 B2 * 5/2005 Shin ..... 399/296

FOREIGN PATENT DOCUMENTS

| | | |
|---|---|---|
| JP | 10-274892 | 10/1998 |
| JP | 11-143255 | 5/1999 |
| JP | 11-352793 | 12/1999 |
| JP | 2004-117884 | 4/2004 |

* cited by examiner

*Primary Examiner*—David M. Gray
*Assistant Examiner*—Ruth N. LaBombard
(74) *Attorney, Agent, or Firm*—Cantor Colburn LLP

(57) ABSTRACT

A color image forming apparatus includes primary transferring units that transfer toner images of different colors from photoreceptors to an intermediate transfer body, a secondary transferring unit that transfers a color toner image from the intermediate transfer body onto a transfer material, a pre-charging unit placed downstream of the primary transferring units and upstream of the secondary transferring unit and that applies electric charge to the color toner image on the intermediate transfer body before the secondary image transfer with the polarity of the applied electrical charge identical to polarity of the potential of the toner, and a potential adjustment unit placed downstream of the pre-charging unit and upstream of the secondary transferring unit, and that applies an electric charge that has a polarity opposite to that of the potential of the toner to the color toner image on the intermediate transfer body.

3 Claims, 1 Drawing Sheet

COLOR IMAGE FORMING APPARATUS WITH PRE-CHARGING UNIT AND POTENTIAL ADJUSTMENT UNIT

This application claims priority from Japanese Patent Application No. JP2004-310705 filed on Oct. 26, 2004, which is incorporated hereinto by reference.

BACKGROUND OF THE INVENTION

The present invention relates to a color image forming apparatus of the electro-photographic method.

For example, in a color image forming apparatus of the electro-photographic method used in copying machines, printers, etc., normally, primary toner images of different colors are formed on a plurality of photoreceptors, these primary toner images are transferred successively onto an intermediate transfer body by primary image transfer thereby forming a color toner image, and subsequently a secondary image transfer is made of this color toner image onto a transfer medium, and thereafter, the color image is formed by fixing the color toner image on the transfer material by carrying out a fixing operation.

Since the potential on the intermediate transfer body is determined by the amount of toner adhered within a specific area, the electric surface potential of the part of the intermediate transfer body of a color image forming apparatus in which toners of several colors have been superimposed will be larger than the electrostatic surface potential of the area in which toner of only one color is adhered, there is the problem that, when the potential distribution is broad in a color toner image formed in this manner, image defects occur in the obtained color image as a result of various transfer defects occurring in the secondary image transfer process.

Methods have been proposed in order to solve the above problem, such as, for example, carrying out pre-charging operation on the color toner image prior to secondary image transfer thereby applying an electric charge with the same polarity as that of the toner potential to the color toner image before the secondary image transfer process and thus raising the potential of the part of the color toner image at which the potential is excessively low to within a range appropriate for carrying out secondary image transfer (see, for example, Patent Document 1 to Patent Document 4).

However, if only the pre-charging operation is made prior to the secondary image transfer, it is not possible to lower the potential of the part of the color toner image at which the potential is excessively high to within a range appropriate for carrying out the secondary image transfer, and as a result of leakage of electrical charge during the secondary image transfer process caused by the presence of parts of the color image toner at which the potential is excessively high image defects are generated such as streaks of discharges, etc. In order to suppress the generation of such discharge streaks, although it is effective to lower the transfer voltage applied during the secondary image transfer process, reducing the transfer voltage is likely to cause image defects in the obtained image such as uneven density or toner splashes due to the presence of parts in the color toner image at which the potential is excessively high.

Patent document 1: Japanese Patent Application Laid Open No. Hei 10-274892

Patent document 2: Japanese Patent Application Laid Open No. Hei 11-143255

Patent document 3: Japanese Patent Application Laid Open No. Hei 11-352793

Patent document 4: Japanese Patent Application Laid Open No. 2004-117884

SUMMARY OF THE INVENTION

The present invention was made based on the above current state of the art, and the purpose of the present invention is to provide a color image forming apparatus in which the generation of image defects such as uneven density or toner splashes are suppressed and good color images are obtained irrespective of the amount of adhesion of the toner constituting the color toner image.

A color image forming apparatus according to the present invention is constituted by a plurality of photoreceptors that respectively form the toner images of different colors, an intermediate transfer body for carrying out successive primary image transfers of each of the toner images of the plurality of photoreceptors, a plurality of primary transferring units that carry out the primary image transfer onto the intermediate transfer body, a secondary transferring unit that transfers a color toner image formed by superimposing on the intermediate transfer body onto a transfer material, a pre-charging unit that is placed on the downstream side of the primary transferring units in the direction of movement of the intermediate transfer body and upstream of the secondary transferring unit and that applies electric charge to the color toner image on the surface of the intermediate transfer body before the second image transfer with the polarity of the applied electrical charge being the same as that of the potential of the toner, and a potential adjustment unit that is placed downstream of the pre-charging unit in the direction of movement of the intermediate transfer body and upstream of the secondary transferring unit, and that applied an electric charge that has a polarity opposite to that of the potential of the toner, to the color toner image on the intermediate transfer body.

In such a color image forming apparatus, it is preferable that the pre-charging unit and the potential adjustment unit are spaced away from and opposing the intermediate transfer body.

In a such a color image forming apparatus, it is preferable that the potential of the formed color toner image is in the range of 0.5 V-2 V if the potential is V of the part at which the amount of toner adhesion is a maximum in a black color toner image that is formed using only a black color toner without operating the pre-charging unit and the potential adjustment unit.

According to the color image forming apparatus of the prevent invention, since an electric charge with the same polarity as the potential of the toner constituting the color toner image is applied by the pre-charging unit so that the potential of the entire color toner image formed on the intermediate transfer body is uniform, that is, irrespective of whether the quantity of toner is small or large and irrespective of whether the toner is present or not, and further since the potential is reduced uniformly by the potential adjustment unit, it is possible to make the distribution of the electric charge have a high uniformity in the color toner image within the appropriate range for the secondary image transfer operation, and hence it is possible to obtain image transfer characteristics having a high uniformity in the color toner image during the secondary image transfer process. As a result, it is possible to obtain satisfactory color images without generating image defects.

DETAILED DESCRIPTION OF THE PREFERRED EMBODIMENT

Figure 1:
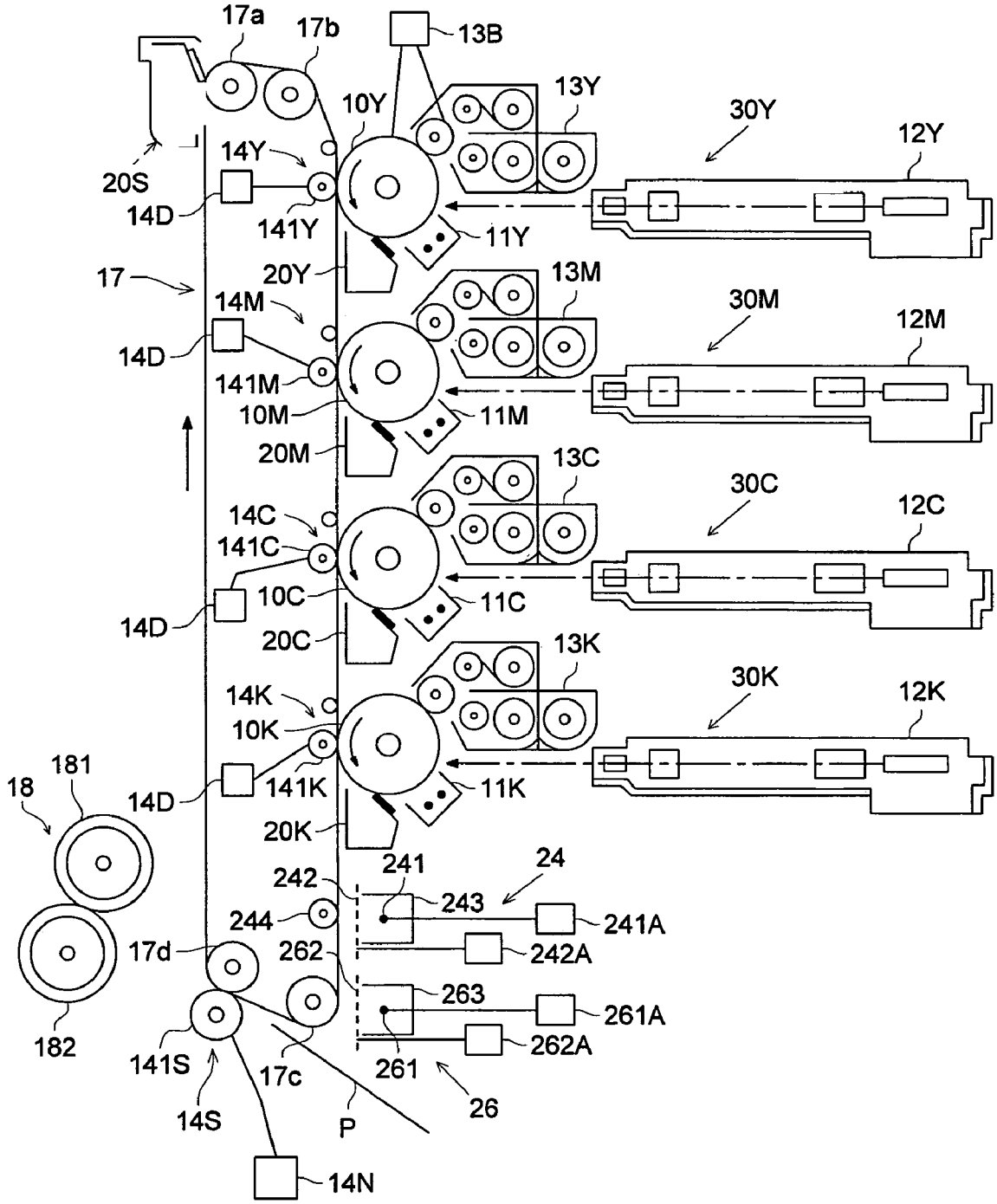
FIG. 1 is an explanatory diagram showing an example of the configuration of the color image forming apparatus according to the present invention.

The present invention is described in detail in the following while referring to the drawing.

FIG. 1 is an explanatory diagram showing an example of the configuration of a color image forming apparatus that forms color images according to the present invention.

This color image forming apparatus is of the so called intermediate transfer method in which the toner images of mutually different colors formed on a plurality of photoreceptors are successively transferred by primary image transfer onto a common intermediate transfer body thereby superimposing the toner images of different colors one upon the other, and a color toner image is formed on the transfer material by carrying out secondary image transfer in a single operation of transferring onto the transferring material the color toner image formed on this intermediate transfer body.

This color image forming apparatus is provided with an intermediate transfer body 17 that is made of an endless belt that carries out circulatory movement in the direction of the arrow shown in FIG. 1, on the outer peripheral surface area of this intermediate transfer body 17 are provided, in the direction of movement of the intermediate transfer body 17, four toner image forming units 30Y, 30M, 30C, and 30K that are spaced away from each other and that form respectively yellow toner image, magenta toner image, cyan toner image, and black toner image successively. The intermediate transfer body 17 is entrained about a set of rollers constituted by the intermediate rollers 17*a*, 17*b*, and 17*c* and the backup roller 17*d* to be described later so that it carries out circulatory movement while coming into contact with the photoreceptors 10Y, 10M, 10C, and 10K due to the primary transferring units 14Y, 14M, 14C, and 14K in the different toner image forming units 30Y, 30M, 30C, and 30K.

The intermediate transfer body 17 is constituted by an endless belt having partial electrical conductivity such as, for example, having a surface resistivity of $1\times10^{4}$–$1\times10^{12}$ Ω/sq. The surface resistivity is a value measured using a resistance meter (Hairestar IP, manufactured by Yuka Electronics) in an environment of room temperature and room humidity (temperature of 20° C.±1° C. and relative humidity of 50±2%) by applying a voltage of 100 V for 10 seconds.

It is preferable that this intermediate transfer body 17 is formed using polyimide type resins, for example, thermosetting polyimide, denatured polyimide, etc.

In the toner image forming unit 30Y of the yellow toner image is provided a rotating drum-shaped photoreceptor 10Y, and on the outer peripheral area of this photoreceptor 10Y are provided, in the direction of rotation of the photoreceptor 10Y, the pre-charging unit 11Y, the exposure unit 12Y, and the developing unit 13Y that carries out development using a developing agent for the yellow toner image, all in that sequence, and a photoreceptor cleaning unit 20Y having a cleaning blade that cleans the photoreceptor 10Y is provided at a downstream position of the primary transferring unit 14Y provided at a position that is downstream compared to the developing unit 13Y in the direction of rotation of the photoreceptor 10Y.

The photoreceptor 10Y has a photosensitive layer, for example, a resin made to include an organic photoelectric material on the outer periphery of a metallic drum-shaped base.

The pre-charging unit 11Y is composed of a scorotron charger having, for example, a control grid and a charging electrode, and the exposure unit 12Y can, for example, be a laser irradiation unit.

The developing unit 13Y, for example, is provided with a developing sleeve with built-in magnet that rotates while carrying the developing agent and a bias power supply 13B that applies DC bias or DC bias superimposed with AC bias between the photoreceptor 10Y and the developing sleeve.

The primary transferring unit 14Y is constituted by the primary transfer roller 141Y that is placed so as to form the primary image transfer area in the condition in which it is pressed against the surface of the photoreceptor 10Y via the intermediate transfer body 17, and an image transfer power supply 14D including, for example, a constant current power supply that is connected to this primary transfer roller 141Y, and the yellow toner image on the photoreceptor 10Y is transferred onto the intermediate transfer body 17 by supplying current from the primary transfer power supply 14D to the primary transfer roller 141Y, that is, the image transfer is of the so called direct contact transfer method.

The cleaning blade of the photoreceptor cleaning unit 20Y is made, for example, of an elastic body such as urethane rubber, which is not only supported at its end part by a supporting member but also is provided so that its tip part presses against the surface of the photoreceptor 10Y, and the direction extending from the tip side of the cleaning blade is the counter-direction that is opposite to the direction of movement due to rotation of the photoreceptor 10Y at the point of contact.

Even in each of the other toner image forming units 30M, 30C, and 30K, the configurations are similar to that of the toner image forming unit 30Y of the yellow toner image excepting that the developing agent used is, instead of the yellow toner, the magenta toner, the cyan toner, or the black toner, respectively.

At a position further on the downstream side of the position of the toner image forming unit 30K for the black toner on the downstream side of the intermediate transfer body 17 is provided the secondary transferring unit 14S, and this secondary transferring unit 14S is constituted by the secondary transfer roller 141S that is placed so as to form the secondary image transfer area by pressing the backup roller 17*d* via the intermediate transfer body 17, and the secondary image transfer power supply 14N that is connected to this secondary transfer roller 141S, and the color toner image formed on the intermediate transfer body 17 is transferred by secondary transfer onto the transfer material P that has been fed by transporting by supplying current from the secondary transfer power supply 14N to the secondary transfer roller 141S, that is, the image transfer is of the so-called direct contact transfer method.

In FIG. 1, the numeral 18 refers to the fixing unit that forms the image by fixing the color toner image on the transfer material P that has been transported from the secondary transfer area, and this fixing unit is constituted by, for example, a heating roller 181 that is provided with an internal heat source, and a pressure roller 182 that is provided so that the fixing nip section is formed when it comes into pressure contact with the heating roller 181.

Further, at a position on the downstream side of the secondary transferring unit 14S in the direction of movement of the intermediate transfer body 17 is provided the intermediate transfer body cleaning unit 20S that is provided with a cleaning blade that removes the non-transferred toner on the intermediate transfer body 17.

In this manner, in the color image forming apparatus according to the present invention, on the downstream side of the primary transferring unit 14K at the most downstream position in the direction of movement of the intermediate transfer body 17, and also on the upstream side of the secondary transferring unit 14S are provided the pre-charging unit 24 constituted by, for example, a scorotron charger having a control grid, and the potential adjustment unit 26, along the direction of movement of the intermediate transfer body 17 in that sequence.

The pre-charging unit 24 has the function of applying electric charge to the color toner image with the polarity of the charge being the same as that of the voltage of the toner constituting the color toner image, and is constituted by a discharging electrode 241 made of a discharging wire, a control grid 242 for controlling the magnitude of the potential of the color toner image by restricting the quantity of electric charge applied to the color toner image by the discharging electrode 241, and a supporting member 243 that is made of a conducting material and that supports the discharging electrode 241 and the control grid 242.

The control grid 242 is provided opposite the surface of the intermediate transfer body 17 so as to have a gap of, for example, 1 mm away from it, and on the back surface of the intermediate transfer body 17 is provided the supporting roller 244 opposing the control grid 242 with the intermediate transfer body 17 positioned in between them.

This supporting roller 244 is maintained in the grounded state while the supporting member 243 is maintained at the same potential as the control grid 242.

Further, bias voltages are applied to the discharging electrode 241 and to the control grid 242 respectively from the pre-charging power supply 241A and pre-charging grid power supply 242A so as to apply to the color toner image an electric charge with a same polarity as the voltage of the toner constituting the color toner image.

The magnitudes of the bias voltages applied to the discharging electrode 241 and to the control grid 242 are such that, for example, if the toner constituting the toner image has negative electric polarity, the magnitude of the bias voltage applied to the discharging electrode 241 is −3 kV to −5 kV and the magnitude of the bias voltage applied to the control grid 242 is −200 V to −400 V.

The potential adjustment unit 26 has the function of applying electric charge to the color toner image on the intermediate transfer body 17 with the polarity of the charge being opposite to that of the voltage of the toner constituting the color toner image, that is, a polarity opposite to the charge applied to it by the pre-charging unit 24, and is constituted by a discharging electrode 261 made of a discharging wire, a control grid 262 for controlling the magnitude of the potential of the color toner image by restricting the quantity of electric charge applied to the color toner image by the discharging electrode 261, and a supporting member 263 that is made of a conducting material and that supports the discharging electrode 261 and the control grid 262.

The control grid 262 is provided opposite the surface of the intermediate transfer body 17 so as to have a gap of, for example, 1 mm away from it, and is opposite the intermediate roller 17*c* via the intermediate transfer body 17.

This intermediate roller 17*c* is maintained in the grounded state while the supporting member 263 is maintained at the same potential as the control grid 262.

Further, bias voltages are applied to the discharging electrode 261 and to the control grid 262 respectively from the pre-charging power supply 261A and pre-charging grid power supply 262A so as to apply to the color toner image an electric charge with a polarity opposite to that of the voltage of the toner constituting the color toner image.

The magnitudes of the bias voltages applied to the discharging electrode 261 and to the control grid 262 are such that, for example, if the toner constituting the toner image has negative electric-polarity, the magnitude of the bias voltage applied to the discharging electrode 261 is +3 kV to +5 kV and the magnitude of the bias voltage applied to the control grid 262 is −50 V to −300 V.

These units, that is, the pre-charging unit 24 and the potential adjustment unit 26 make the potential of the formed toner image come to the range of 0.5 V-2 V, or more preferably to the range of 0.7 V-0.1.4 V if the potential is V of the part at which the amount of toner adhesion is a maximum in a black color toner image that is formed using only a black color toner without operating this pre-charging unit 24 and this potential adjustment unit 26.

<Toner>

The toners used in the above color image forming apparatus should preferably be ones having a weight average particle diameter in the range of 4-7 μm. By using toners having a weight average particle diameter in the range of 4-7 μm, it is possible to reduce the presence of toners having excessive adhesion or toners having weak adhesion with the transfer material P in the fixing process using the fixing unit 18, and hence not only it is possible to obtain stable development characteristics over long periods but also to obtain high transfer efficiency increasing the half-tone image quality, whereby visible images are formed having improved image quality of thin lines or dots etc.

Here, the volume average particle diameter is the average particle diameter measured by a Coulter Counter TA-II unit (manufactured by Beckman-Coulter).

Such toners are obtained by polymerizing polymerizable monomers in a water-based medium, and the fine polymer particles are prepared, for example, by suspension polymerization or by emulsion polymerization of monomers in a liquid to which has been added an emulsifier liquid as a necessary additive, and thereafter, by the coagulating method of adding an organic solvent or a coagulant. At the time of coagulation, it is also possible to use the methods of carrying out coagulation after mixing dispersion liquids such as mold releasing agents or coloring agents necessary for the composition of the toner, or of carrying out emulsion polymerization after dispersing the toner constituent materials such as mold releasing agents or coloring agents. Here, the word "coagulation" implies the fusion of several particles of the resin and the coloring agent. In addition, the water-based medium in the present invention implies one that has at least 50% by mass of water.

Taking an example of the method of manufacturing such a toner, various constituent materials such as coloring agents and, if necessary, mold releasing agents, charge control agents, and also polymerization initiating agents, etc., are added to the polymerizing monomer and the different constituent materials are dissolved or dispersed in the polymerizing monomer using a homogenizer, sand mill, sand grinder, or ultrasonic dispersing equipment, etc. This polymerizing monomer in which the different constituent materials are dissolved or dispersed is dispersed in a water-based medium containing a dispersion stabilizing agent using a homo-mixer or a homogenizer so as to have oil droplets with the desired size as a toner. Thereafter, it is transferred to a reaction equipment in which the stirring mechanism is stirring blades described later, and the polymerization process is made to proceed by heating. After the polymerization reaction is completed, the dispersion stabilizing agent is removed, and the toner is produced by filtering, cleaning, and further drying.

It is preferable that the degree of spherical nature of the toner is in the range of 0.94-0.98. The degree of spherical nature is obtained, for example, by sampling 500 times enlarged toner particle images of 500 randomly chosen resin particles using a scanning electron microscope (SEM) and carrying out toner particle image analysis using an image analyzing equipment (the Scanning Image Analyzer manufactured by Nihon Denshi) and calculating using Equation 1 below.

Degree of spherical nature=(circumference of a circle with the same area as the particle projection)/(circumference of the particle projection). Equation 1

When the degree of spherical nature is less than 0.94, the unevenness of the particles becomes large, the particles are likely to be crushed due to being subjected to large stresses in the machine, and since the tone particles are not charged uniformly in the developing units 13Y, 13M, 13C, and 13K, it is not possible to form satisfactory visible images. On the other hand, when the degree of spherical nature is higher than 0.98, since the toner particles are very close to being perfect spheres, the cleaning performance becomes degraded.

In the color image forming apparatus according to the present invention, by using developing agents including toners that have been manufactured according to the method described above and that have shapes with spherical shapes and small diameters satisfying the specific conditions, it is possible to increase the half-tone image quality and to form visible images having improved image quality of thin lines or dots, etc.

The toners described above can be used as single component developing agents or as two-component developing agents.

When using the toners as single component developing agents, it is possible to consider the use of non-magnetic single component developing agents or magnetic developing agents in which the toner is made to include magnetic particles of sizes in the range of 0.1-0.5 μm, and either type of these can be used in the present invention.

Further, when using as a two-component developing agent by mixing with a carrier, it is possible to use as the magnetic particles of the carrier materials considered conventionally as appropriately suitable such as metallic iron, ferrite, magnetite, etc., or alloys of such metals and other metals such as aluminum, lead, etc., and ferrite particles are particularly preferable. The volume average particle diameters of the above magnetic particles are preferably in the range of 15 μm-100 μm, and still more preferably in the range of 25 μm-80 μm.

The volume average particle diameters of the carrier can be measured typically using a laser diffraction type particle size distribution measuring apparatus "HELOS" (manufactured by Sympatec Corporation) provided with a wet type dispersion unit.

In this color image forming apparatus, the image forming operation is carried out in the following manner. That is, in each of the toner image forming units 30Y, 30M, 30C, and 30K, the photoreceptors 10Y, 10M, 10C, and 10K are rotated by driving, these photoreceptors 10Y, 10M, 10C, and 10K are charged to a specific polarity, for example, to negative polarity, by the charging units 11Y, 11M, 11C, and 11K, and next, in the image forming areas on the surfaces of the photoreceptors where the toner images are to be formed, the potentials are reduced at the illuminated locations (the exposed regions) due to the exposures by the exposing units 12Y, 12M, 12C, and 12K thereby forming the electrostatic latent images on the photoreceptors 10Y, 10M, 10C, and 10K corresponding to the image of the original document, the toners charged to the same polarity as the surface potentials of the photoreceptors 10Y, 10M, 10C, and 10K, for example, with a negative polarity, get adhered to electrostatic latent images of the photoreceptors 10Y, 10M, 10C, and 10K thereby carrying out negative development and thus forming the toner images of the different colors.

Further, the toner images of different colors in the primary transfer areas are successively subjected to primary image transfer by the respective primary transferring units 14Y, 14M, 14C, and 14K in a superimposing manner thereby forming the color toner image on the intermediate transfer body 17.

Next, electric charge is applied with the same polarity as that of the toner potential so that the entire color toner image is taken to a uniformly high potential by the pre-charging unit 24, and thereafter, the potential is reduced uniformly to an appropriate voltage in the secondary image transfer process by the voltage adjustment unit 26.

Thereafter, a secondary image transfer potential controlled to an appropriate voltage by the secondary image transfer power supply is applied to the secondary transfer roller 141S of the secondary transferring unit 14S, and the color toner image having a uniform potential state as described above is subjected to secondary image transfer whereby the color toner image on the intermediate transfer body 17 is transferred to the transfer material P that has been transported, and then the fixing process is carried out by the fixing unit 18 thereby forming the color image.

In the toner image forming units 30Y, 30M, 30C, and 30K, the non-transferred toner remaining on the photoreceptors 10Y, 10M, 10C, and 10K after passing through the primary image transfer area is removed by the cleaning blades of the photoreceptor cleaning units 20Y, 20M, 20C, and 20K.

In addition, the non-transferred toner remaining on the intermediate transfer body 17 that has passed through the secondary image transfer area is removed by the cleaning blade of the intermediate transfer body cleaning unit 20S.

According to the above color image forming apparatus, since an electric charge with the same polarity as the potential of the toner constituting the color toner image is applied by the pre-charging unit 24 so that the potential of the entire color toner image formed on the intermediate transfer body 17 is uniform, that is, irrespective of whether the quantity of toner is small or large and irrespective of whether the toner is present or not, and further since the potential is reduced uniformly by the potential adjustment unit 26, it is possible to make the distribution of the electric charge have a high uniformity in the color toner image within the appropriate range for the secondary image transfer operation, and hence it is possible to obtain image transfer characteristics having a high uniformity in the color toner image during the secondary image transfer process. As a result, there is no occurrence of image defects such as image deterioration, toner splashes, or uneven density and it is possible to obtain satisfactory color images.

EXAMPLE

In the following, Examples of the present invention made for confirming the effects of the invention are described in the following. However, the present invention shall not be construed to be limited to the Examples.

Example 1

A color image forming apparatus according to the present invention was fabricated with a configuration shown in FIG. 1. The concrete configuration was as follows.

(1) The photoreceptor used was with a 25 μm thick organic photosensitive layer with negative electric polarity and made of polycarbonate in which phthalocyanine pigment is dispersed coated on an aluminum drum shaped metal base with an external diameter of 60 mm, a length of 335 mm in the direction of its axis, and a wall thickness of 1 mm, and the linear velocity was set as 220 mm/sec when the photoreceptor was rotated.

(2) The organic photoreceptor was negatively charged using as the charging unit a scorotron charger having negative electric discharge polarity.

(3) The exposing unit used was a semiconductor later illuminating apparatus with a standard surface output of 300 μW.

(4) The developing unit used was of the two-component developer type.

(5) The developing agent used was one that contained 4% by mass of a toner having negative electric polarity with a weight average particle diameter of 4.5 μm.

(6) The distance between the axes of rotation of the image carrying body in the neighboring toner image forming units was 95 mm.

(7) The primary transferring units used were of the contact transfer type using primary transfer rollers, the primary transfer roller had an external diameter of 20 mm, resistance value of $1\times10^6$ Ω, Asker C hardness of 25°, with the outer peripheral of a stainless steel cylindrical conducting core being coated with a coating layer made of conductive rubber in the form of a foam-sponge of carbon dispersed in silicone rubber. The pressing force of this primary transfer roller against the photoreceptor was set at 4.9 N, and the value of the current supply to the primary transfer roller by the primary transfer power supply was set at 35 μA.

(8) The cleaning blade of the photoreceptor cleaning unit was made of urethane rubber and rubber hardness of the material constituting this cleaning blade was JIS A hardness of 70°, repulsion elastic coefficient of 30%, thickness of 2 mm, and free length of 9 mm. The effective contact angle was set at 17° between this cleaning blade and the intermediate transfer body, and the cleaning blade contacted the intermediate transfer body in a direction opposite to the direction of movement by rotation of the intermediate transfer body and that pressing force was 196 mN/cm.

(9) The intermediate transfer body used was an endless partially conducting polyimide resin belt with a peripheral length of 861 mm, a surface resistivity of $1\times10^{11}$ Ω/sq., a volume resistivity of $1\times10^8$ Ω·cm, and the tension of the belt was such that 49 N.

(10) The pre-charging unit used was a scorotron charger.

(11) The potential adjustment unit used was a scorotron charger.

(12) The secondary transferring unit used was of the contact transfer type using a secondary transfer roller, the secondary transfer roller had an external diameter of 30 mm, resistance value of $1\times10^7$ Ω, Asker C hardness of 67°, with the outer peripheral of a stainless steel cylindrical conducting core being coated with a coating layer made of conductive rubber in the form of a foam-sponge of carbon dispersed in silicone rubber.

The pressing force of this secondary transfer roller against the photoreceptor was set at 40 N, and the value of the transfer voltage supplied to the secondary transfer roller by the secondary transfer power supply was set at 3 kV.

(13) The cleaning blade of the intermediate transfer body cleaning unit was made of urethane rubber and rubber hardness of the material constituting this cleaning blade was JIS A hardness of 70°, repulsion elastic coefficient of 30%, thickness of 2 mm, and free length of 9 mm. The effective contact angle was set at 17° between this cleaning blade and the intermediate transfer body, and the cleaning blade contacted the intermediate transfer body in a direction opposite to the direction of movement by rotation of the intermediate transfer body and that pressing force was 196 mN/cm.

(14) The fixing unit used was of the heart roller fixing method and constituted by a heat roller and a pressure roller and the fixing temperature was set at 200° C.

The following actual image formation tests were carried out using a color image transfer apparatus of the above type. The results have been shown in Table 1.

(Actual Image Formation Test)

With the above, a color printing paper with a base weight of 80 g/mm$^2$ was used as the transfer material, and the surface voltage of the organic photosensitive material in the non-exposed areas of each of the toner image forming units was set at −700 V and the surface potential of the organic photoconductive material in the exposed area was set at −50 V. In a low temperature and low humidity environment (10° C., 20% RH) at DC bias voltage of −2.5 kV was applied to the discharging electrode of the pre-charging unit and a DC bias voltage of −400 V was applied to the control grid. A DC bias voltage of +5 kV was applied to the discharging electrode of the potential adjustment unit and a DC bias voltage of −100 V was applied to the control grid. One sheet each of a high density full color image, a high density two-color image is in magenta and cyan, monochrome image in black color, and a single color half-tone image in black color were output, and the image quality of the obtained images was observed visually. Here, an image without any density variations, toner splashing, and image unevenness was taken as a "good" image and the results are shown in Table 1.

Comparative Example 1

Actual image formation test was carried out similar to the Example 1 using a color image forming apparatus identical to that in the Example 1 except that the pre-charging unit and the potential adjustment unit were not provided, and the results are shown in Table 1.

Comparative Example 2

Actual image formation test was carried out similar to the Example 1 using a color image forming apparatus identical to that in the Example 1 except that the potential adjustment unit was not provided, and the results are shown in Table 1.

Comparative Example 3

Actual image formation test was carried out similar to the Example 1 using a color image forming apparatus identical to that in the Example 1 except that the pre-charging unit was not provided, and the results are shown in Table 1.

TABLE 1

| | Type of image | Voltage before operation (V) | Voltage after operation (V) | Image quality |
|---|---|---|---|---|
| Example 1 | Full color | −205 | −132 | Good |
| | Two-color | −172 | −120 | Good |
| | Single color | −92 | −115 | Good |
| | Single color half-tone | −19 | −109 | Good |
| Comparative Example 1 | Full color | −205 | −205 | uneven density, toner splashing |
| | Two-color | −172 | −172 | uneven density, toner splashing |
| | Single color | −92 | −92 | Good |
| | Single color half-tone | −19 | −19 | Image unevenness |
| Comparative Example 2 | Full color | −205 | −205 | uneven density, toner splashing |
| | Two-color | −172 | −172 | uneven density, toner splashing |
| | Single color | −92 | −98 | Good |
| | Single color half-tone | −19 | −95 | Good |
| Comparative Example 3 | Full color | −205 | −124 | Good |
| | Two-color | −172 | −116 | Good |
| | Single color | −92 | −92 | Good |
| | Single color half-tone | −19 | −19 | Image unevenness |

As is clear from the results of Table 1, in a color image forming apparatus according to the Example 1 in which a pre-charging unit and a potential adjustment unit have been provided, there is no generation of image defects such as uneven density, toner splashing, and image unevenness.

In contrast to this, in a color image forming apparatus according to the comparative example 1 in which both the pre-charging unit and the potential adjustment unit have not been provided, generation of uneven density and toner splashing were observed in the formed full color images and two-color images, and image unevenness were observed in single color half-tone images because of the presence of portions with excessively low potential in the color toner image. Further, in a color image forming apparatus according to the comparative example 2 in which the potential adjustment unit has not been provided, generation of uneven density and toner splashing were observed in the formed full color images and two-color images. In addition, in a color image forming apparatus according to the comparative example 3 in which the pre-charging unit has not been provided, generation of image unevenness was observed in the formed single color half-tone images.

What is claimed is:

1. A color image forming apparatus for forming a color toner image on a transfer material, comprising:

(a) a plurality of photoreceptors on each of which a toner image having a color different from each other is formed;

(b) an intermediate transfer body onto which the toner image formed on each of the photoreceptors is primary transferred successively;

(c) a primary transferring unit for primary transferring the toner image;

(d) a secondary transferring unit for secondary transferring the color toner image which has been formed by superimposing each of the toner images on the intermediate transfer body, onto a transfer material;

(e) a pre-charger provided downstream of the primary transferring units with respect to a moving direction of the intermediate transfer body and upstream of the secondary transferring unit for applying an electric charge having the same polarity as that of an electric potential of a toner onto the color toner image prior to the secondary transferring on a surface of the intermediate transfer body; and (f) an electric potential adjusting device provided downstream of the pre-charger with respect to the moving direction of the intermediate transfer body and upstream of the secondary transferring unit for applying an electric charge having a polarity opposite to an electric potential of the toner onto the color toner image on the surface of the intermediate transfer body, and for applying a bias voltage having the same polarity as that of the electric potential of the toner onto a control grid.

2. The color image forming apparatus of claim 1, wherein each of the pre-charger and the electric potential adjusting device is spaced apart from and faces the intermediate transfer body.

3. The color image forming apparatus of claim 1, wherein when V represents an electric potential of a part at which an adhering amount of toner of a black toner image which is formed by only a black toner without operating the pre-charger and the electric potential adjusting device shows a maximum amount, the electric potential adjusting device applies the electric charge onto the color toner image so that an electric potential of the color toner image formed is set to 0.5 to 2 V.

* * * * *